United States Patent [19]

Hefner, Jr.

[11] 4,450,070

[45] May 22, 1984

[54] IMIDAZOLINE CONDITIONER FOR THE FLOTATION OF OXIDIZED COAL

[75] Inventor: Robert E. Hefner, Jr., Lake Jackson, Tex.

[73] Assignee: The Dow Chemical Company, Midland, Mich.

[21] Appl. No.: 320,989

[22] Filed: Nov. 13, 1981

[51] Int. Cl.[3] ..... B03B 1/00

[52] U.S. Cl. ..... 209/3; 209/166; 209/167; 252/61

[58] Field of Search ..... 209/166, 167, 9, 3; 252/61.1; 210/729

[56] References Cited

U.S. PATENT DOCUMENTS

| | | | |
|---|---|---|---|
| 2,708,666 | 5/1955 | Carpenter | 260/97.5 |
| 2,713,583 | 7/1955 | Smith | 252/61 |
| 2,792,404 | 5/1957 | Garmaise et al. | 252/61 |
| 2,839,191 | 6/1958 | Monson et al. | 209/166 |
| 4,081,363 | 3/1978 | Grayson | 209/166 |
| 4,110,207 | 8/1978 | Wang et al. | 209/166 |
| 4,222,862 | 9/1980 | Finch | 209/166 |
| 4,278,533 | 7/1981 | Hefner | 209/166 |
| 4,342,648 | 8/1982 | Biss et al. | 209/166 |

FOREIGN PATENT DOCUMENTS 1407134 9/1975 United Kingdom .

OTHER PUBLICATIONS

P. S. Belov et al., *Abhanlungen Akademie der Wissenschaften der DDR*, vol. 1, No. 4, pp. 225–233 (1976).

*Primary Examiner*—Bernard Nozick

[57] ABSTRACT

Froth flotation of oxidized coal in the presence of certain imidazoline or imidazolinium salts improves both the selectivity and recovery attained. Imidazolines found particularly efficacious are those bearing a fatty alkyl group in the 2- position and an N-aminoethyl or N-hydroxyethyl group. Preferred imidazolinium salts are those corresponding to the following formula:

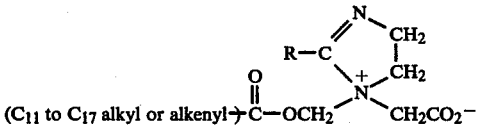

wherein R is a $C_6$ to $C_{22}$ alkyl or alkenyl group.

5 Claims, No Drawings

IMIDAZOLINE CONDITIONER FOR THE FLOTATION OF OXIDIZED COAL

BACKGROUND OF THE INVENTION

This invention relates to the flotation of coal having an oxidized surface to recover coal containing a lower percentage of impurities. In particular, this invention relates to the use of specific imidazoline compounds or imidazolinium salts to enhance the floatability of oxidized coal.

The natural process of "coalification" inherently deposits some non-combustible mineral matter in association with the combustible carbonaceous solids. Large fragments of coal together with non-combustible matter can be separated by screening or other conventional concentration techniques. Other methods more efficiently separate fine material intimately associated with the carbonaceous solids.

Froth flotation is sometimes employed to beneficiate finely-divided raw coal. Bituminous coals possess a natural hydrophobicity, which results in coals being readily floatable in the presence of a frother, such as methyl isobutyl carbinol, and a relatively mild collector, such as kerosene. However, coals of all ranks which have an oxidized or partially oxidized surface are much more difficult to float.

The loading of the oily collector is generally 0.05 to 1 kilogram per metric ton of coal feed for bituminous coals of intermediate or low rank, with the loading being relatively greater for the flotation of lignite and anthracite coals. However, good recovery of oxidized coals or lignite coals can only be effected at such high loadings of the collector that significant amounts of inert material are floated along with the combustible materials. Sun suggests in *Trans. AIME,* 199:396–401 (1954), that fatty amines can be utilized as co-collectors in the flotation of oxidized coals to effect enhanced recovery. However, even these amine collectors float substantial amounts of ash along with the coal and effect only partial recovery of combustible material.

Belov et al. report in an article in *Abhandlungen der Akademie der Wissenchaften der DDR,* Vol. 1, No. 4, pp. 225–33 (1976), that 2-aryl-2-imidazolines are useful as flotation agents for coal. This article is abstracted in *Chem. Abstracts,* 88:107, 116m (1978). However, the 2-aryl-2-imidazoline compounds have exhibited little activity in the flotation of oxidized coal in experiments detailed herein.

SUMMARY OF THE INVENTION

In accordance with this invention, coal having an oxidized surface is beneficiated by (a) classifying the coal to separate particles of flotation size; and (b) floating the sized coal in a frothing aqueous medium comprising a fuel oil collector and an effective amount of a compound corresponding to the formula

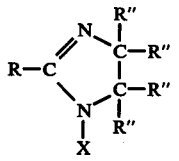

(I)

or

-continued

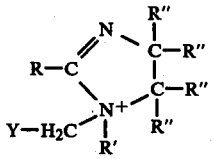

(II)

wherein

R is a $C_1$ to $C_{22}$ alkyl or $C_2$ to $C_{22}$ alkenyl;

R″ at each occurrence is independently —H, a $C_1$–$C_4$ alkyl or a $C_1$–$C_4$ hydroxyalkyl;

X is —H, $C_1$ to $C_{22}$ alkyl, $$-CH_2CH_2NH-\underset{\underset{O}{\|}}{C}\leftarrow C_1 \text{ to } C_{22}$$

alkyl, $C_2$ to $C_{22}$ alkenyl or —H), $-CH_2CH_2NH_2$, $-CH_2CH_2OH$, $$-CH_2CH_2O\overset{\overset{O}{\|}}{C}\leftarrow C_1 \text{ to } C_{22} \text{ alkyl},$$

$C_2$ to $C_{22}$ alkenyl or —H, $$-CH_2CH_2O\underset{\underset{Q}{|}}{C}H\underset{\underset{Q}{|}}{C}H-OH,$$

each Q being independently —H or $-CH_3$, or $$-CH_2CH_2O(CH_2)_t\overset{\overset{O}{\|}}{C}-O\leftarrow C_1$$

to $C_{22}$ alkyl, $C_2$ to $C_{22}$ alkenyl or —H), t being an integer 1 or 2;

Y is —H, $C_1$ to $C_{21}$ alkyl, $-CH_2OH$, $$-CH_2O\overset{\overset{O}{\|}}{C}\leftarrow C_1$$

to $C_{22}$ alkyl or $C_2$ to $C_{22}$ alkenyl) or $$-CH_2CH_2O\underset{\underset{Q}{|}}{C}H\underset{\underset{Q}{|}}{C}H-OH,$$

each Q being independently —H or $-CH_3$; and

R′ is $$-CH_2-\overset{\overset{O}{\|}}{C}-O^{\ominus} \text{ or } -CH_2-\underset{\underset{M}{|}}{C}H-CH_2-SO_3^{\ominus},$$

M being —H, —OH or $$-O-\underset{\underset{O}{\|}}{C}\leftarrow H,\ C_1 \text{ to } C_{22} \text{ alkyl}$$

or $C_2$ to $C_{22}$ alkenyl), with the proviso that in the compound corresponding to formula I or II at least one of the groups represented by R, X, Y and M is or contains a terminal alkyl or alkenyl group having at least 6 carbon atoms.

DETAILED DESCRIPTION OF THE INVENTION

The imidazoline compounds and imidazolinium salts employed in the instant flotation process are generally compounds well known in the art. Many of these compounds and salts are commercially available or can be readily prepared from commercially available surfactants.

The compounds corresponding to formula I wherein X is —H or $C_1$ to $C_{22}$ alkyl are conveniently prepared by reacting ethylenediamine, N-alkylethylenediamine or a substituted derivative thereof with a $C_2$ to $C_{23}$ alkanoic acid or corresponding acid anhydride so as to remove two equivalents of water for each equivalent of acid or anhydride reacted. This reaction is well known in the art. The completion of the reaction can conveniently be monitored by infrared spectroscopy or the quantity of water removed overhead during the condensation reaction.

The compounds corresponding to formula I wherein X is $-CH_2CH_2OH$ are conveniently prepared by reacting hydroxyethylethylenediamine or a substituted hydroxyethylethylenediamine with a $C_2$–$C_{23}$ alkanoic acid or the corresponding acid anhydride so as to remove two equivalents of water for each equivalent of fatty acid or anhydride reacted. This reaction can be performed in the manner taught in U.S. Pat. No. 2,267,965.

The compounds corresponding to formula I wherein X is $-CH_2CH_2OH$ can be esterified in the conventional manner with formic acid, an alkanoic acid or a carboxylic acid anhydride to convert X to $$-CH_2CH_2O\overset{\overset{\displaystyle O}{\|}}{C}-Z,$$

wherein Z is —H or a $C_1$ to $C_{22}$ alkyl group derived from a carboxylic acid. These compounds can also be reacted with an alkylene oxide. The compounds wherein X is $-CH_2CH_2OH$ can also be reacted with acrylic acid or corresponding esters to prepare compounds of formula I wherein X is $$-CH_2CH_2O(CH_2)_2\overset{\overset{\displaystyle O}{\|}}{C}-OZ,$$

Z being defined hereinbefore. Such compounds can also be obtained commercially from Mona Industries Inc. Compounds of formula I, wherein X is $$-CH_2CH_2O-CH_2-\overset{\overset{\displaystyle O}{\|}}{C}-OH,$$

can be obtained from this same source.

The compounds corresponding to formula I wherein X is $-CH_2CH_2NH_2$, can conveniently be prepared by reacting diethylenetriamine or a substituted diethylenetriamine with a $C_2$–$C_{23}$ fatty acid or a corresponding acid anhydride so as to remove two equivalents of water for each equivalent of fatty acid or anhydride reacted. This reaction is describd in detail in U.S. Pat. No. 2,268,273. These compounds can be amidated with an alkanoic or alkenoic acid.

A compound corresponding to the formula

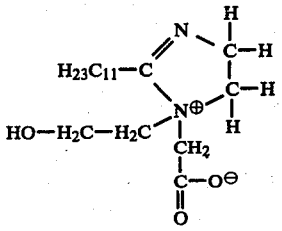

is sold by Miranol Chemical Co., Inc. under the designation Miranol HM Conc. NP. Other compounds having a similar structure but derived from other fatty acids are available from Lonza Inc. and Miranol Chemical Co. Frequently, mixtures of fatty acids are employed commercially in the manufacture of such compounds. These compounds are readily esterified with an alkanoic acid or carboxylic acid anhydride in a known manner to prepare compounds corresponding to Formula II, wherein Y is $$-H_2COC(=O)(C_1 \text{ to } C_{22} \text{ alkyl}).$$

Lonza Inc. markets imidazolinium salts corresponding to formula II wherein Y is H and R′ is as indicated hereinbefore. These compounds can also be prepared and modified by methods known in the art.

It has been found that certain of the aforementioned imidazoline compounds and imidazolinium salts exhibit greater efficacy and/or are more cost effective. Generally, it is preferred that R″ is —H at each occurrence. Preferably, t is the integer 2. Preferably, R is alkenyl or more preferably alkyl and has at least 6 carbon atoms, more preferably from 11 to 17 carbon atoms. It is preferred that X is $-CH_2CH_2NH_2$, $$-CH_2CH_2NH-C(=O)(C_{11}$$

to $C_{17}$ alkyl or $C_{11}$ to $C_{17}$ alkenyl), $-CH_2CH_2OH$, $$-CH_2CH_2O-C(=O)(C_{11}$$

to $C_{17}$ alkyl or $C_{11}$ to $C_{17}$ alkenyl). Preferably, R′ is $$-CH_2-C(=O)-O^{\ominus}$$

and Y is $$-CH_2OC(=O)(C_{11}$$

to $C_{17}$ alkyl or $C_{11}$ to $C_{17}$ alkenyl).

The aforementioned imidazoline compounds or imidazolinium salts can be employed in the presence of the mixture of amide, ester and amide-ester compounds produced when less than 2 equivalents of water are removed for each equivalent of fatty acid reacted with the ethylenediamine, hydroxyethylethylenediamine or the diethylenetriamine. Minor amounts of ammonium salts may also be present. In some experiments it has unexpectedly been found that incomplete conversion of the reactants to the imidazoline product, results in a composition more efficacious in the flotation of oxidized coal than the imidazoline itself. Preferably, at least 20% of the fatty acid and polyamine reactants are converted to the corresponding imidazoline in the conditioner compositions described herein. The term "conditioner" denotes that the condensation product is believed to effect improved recovery of oxidized coal by enhancing the hydrophobicity of the coal surface. However, the use of the descriptive term "conditioner" is not intended to exclude the possibility that this condensation product acts in part as a co-collector with fuel oil.

The deleterious effect of surface oxidation on the floatability of coal is well recognized in the prior art. See, e.g., U.S. Pat. No. 4,222,862 and the references cited therein. The coal to be floated by the instant process can suitably be anthracite, bituminous or subbituminous in rank, so long as the coal has an oxidized surface. By the term oxidized surface is meant coal having a surface oxidized to a degree which impedes the flotation of the coal in conventional agents, such as a fuel oil collector together with a frother. Typically, in coal having an oxidized surface the atomic ratio of oxygen to carbon is greater than 0.026. Coal possessing an oxygen to carbon atomic ratio of greater than 0.035 is particularly difficult to float using conventional agents alone. The greatest improvement in the recovery of coal using the instant conditioners is seen with coal having an oxygen to carbon ratio of at least 0.10. A substantial portion of the oxygen present in a difficult-to-float coal is present in the region near or at the surface of the particle. The percent oxygen and carbon concentrations can be readily determined by conventional techniques of elemental analysis. The claimed conditioners are particularly effective in the flotation of oxidized bituminous coals of intermediate or low rank.

The loading of the claimed imidazoline or imidazolinium salts in the flotation medium which effects the greatest recovery of combustible carbonaceous matter with a tolerable amount of inert matter is influenced by the size, rank, degree of oxidation and inert matter content of the coal feed, as well as the loading of frother and other adjuvants. The term effective amount of the imidazoline or salt thereof is used herein to denote the amount of said product required to increase the recovery of coal by froth flotation in the presence of fuel oil and a frother. Generally, where the conditioner is employed with only fuel oil and a conventional frother, the conditioner is advantageously employed in a ratio of from about 0.001 to about 1.0, preferably about 0.002 to about 0.2 kilograms of conditioner per (metric) ton of coal flotation feed.

The instant conditioners can be utilized in conjunction with co-collectors or other adjuvants, such as activators, conditioning reagents, dispersing reagents, frothing reagents and depressing reagents. Fuel oil is employed in the flotation medium as a collector. Representative fuel oils include diesel oil, kerosene, Bunker C fuel oil, mixtures thereof and the like. The fuel oil can generally be advantageously employed in a ratio of from about 0.02 to about 2.5 kilograms fuel oil per (metric) ton of coal flotation feed. The optimal loading of fuel oil in the flotation medium is influenced by numerous factors, such as the size, degree of oxidation and rank of the coal to be floated and the loading of conditioner and frother. Therefore, the loading of the fuel oil should be optimized empirically to effect the greatest selectivity and recovery during flotation. In one preferred embodiment the conditioner is charged to the flotation medium dispersed in part or all of the fuel oil charge.

A frothing agent should be present in the flotation medium to promote formation of a froth. Conventional frothers, such as pine oil, cresol, $C_4$ to $C_8$ alkanols containing one or two tertiary or one quaternary carbon atom, e.g., isomers of amyl alcohol, are suitable for this purpose. However, methyl isobutyl carbinol and polypropylene glycol alkyl or phenyl ethers are preferred as frothers, with polypropylene glycol methyl ethers having a weight average molecular weight between about 200 and about 600 being most preferred. The optimal loading of frother in the flotation medium is influenced by a number of factors, most important of which is the rank and degree of oxidation of the coal. Generally, a ratio of from about 0.05 to about 0.5 kilogram frother per ton of coal feed is advantageous.

The size of the coal particles to be separated by flotation is important as generally particles larger than about 28 mesh (U.S. Sieve Size) are difficult to float. In typical operations, coal particles larger than 28 mesh, advantageously larger than 100 mesh, are separated from both the inert material mined therewith and more finely divided coal by gravimetric separation techniques. However, if a substantial fraction of the coal in the flotation feed comprises particles larger than 28 mesh, it is desirable that the feed be further comminuted prior to flotation.

The sized coal flotation feed optionally is first washed and then mixed with sufficient water to prepare an aqueous slurry having a solids concentrate which promotes rapid flotation. Generally, a solids concentration between about 2 to about 20 weight percent solids, more preferably from about 5 to about 10 weight percent, is preferred. The aqueous coal slurry is advantageously conditioned with the imidazoline or imidazolinium salt, a frother, fuel oil and any other adjuvants by mixing with the slurry is a manner known to the art. Generally for difficult to float coal, it is advantageous to contact with mixing the coal slurry with the conditioner and fuel oil for a period of time prior to flotation, so as to effect intimate contact of the conditioner and fuel oil with substantially all of the coal. Where the aqueous coal slurry is prepared in a container distinct from the flotation cell and then is conveyed to the flotation through conduits, the desired intimate contact can conveniently be attained by introducing the conditioner and fuel oil to the slurry upstream from the flotation cell. The frother, however, should be introduced to the slurry shortly before or during flotation to provide maximum frothing.

The coal is operably floated at the natural pH of the coal in the aqueous slurry, which can vary from about 3.0 to about 9.5 depending upon the composition of the feed. However, a pH adjusting composition is optionally used as desired to adjust and maintain the pH of the aqueous coal slurry prior to and during flotation to a value from about 4 to about 9, preferably about 4 to about 8, which generally promotes the greatest coal recovery. If the coal is acidic in character, the pH adjusting composition can operably be an alkaline material, such as soda ash, lime, ammonia, potassium hydroxide or magnesium hydroxide, with sodium hydroxide being preferred. If the aqueous coal slurry is alkaline in character, a carboxylic acid, such as acetic acid and the like, or a mineral acid, such as sulfuric acid, hydrochloric acid and the like, are operable to adjust the pH.

In one embodiment of the invention an inorganic or organic acid can be added to the imidazoline or the flotation medium itself to adjust the pH of the flotation medium and modify the characteristics of the conditioner. The addition of an acid can selectively depress the flotation of ash with some imidazoline compounds, but more frequently the recovery of coal is detrimentally affected by the addition of an acid to the conditioner. The addition of acetic acid is particularly deleterious where X in formula I corresponds to $-CH_2CH_2NH_2$.

The conditioned and pH-adjusted aqueous coal slurry is aerated in a conventional flotation machine or bank of flotation cells to float the coal. Any suitable flotation unit can be employed.

The practice of the process of the instant invention can be used alone to beneficiate coal. Alternatively, the process can be used in conjunction with secondary flotations following the instant process to effect even greater beneficiation of the coal.

The following examples are illustrative embodiments of this invention. Unless otherwise indicated, all parts and percentages are by weight.

EXAMPLES 1–9

In a series of otherwise similar flotation runs, different conditioners were employed in the flotation of oxidized coal. In each run about 200 grams of comminuted coal was diluted with deionized water to form a slurry containing 6.67 percent solids. The coal was a low grade bituminous coal having a highly oxidized surface (an atomic ratio of oxygen to carbon greater than 0.1) and containing 14.7 percent ash. The coal feed consisted of more than 90 percent particles smaller than 80 mesh (U.S. Sieve size).

The aqueous coal slurry was introduced into a flotation machine (specifically, a Galigher Agitair flotation machine) having a 3-liter cell. The coal slurry was agitated for two minutes and then sufficient 1 normal sodium hydroxide was added to adjust the slurry pH to 7. The slurry was agitated for 7 additional minutes.

To the aqueous coal slurry was added a 0.5 milliliter (ml) aliquot from a homogeneous mixture of 4.75 grams of a refined kerosene (sold under the trade name SOLTROL 100 by Phillips Petroleum Co.), 4.75 grams of deionized water and 0.5 gram of an imidazoline conditioner corresponding to formula I which optionally contains some amide precursor. In the imidazoline corresponding to formula I, R" at each occurrence is —H, and R and X are as tabulated in Table I. An additional 0.25 gram of kerosene was added to the slurry to effect a loading equivalent to 2.5 kilograms of kerosene per metric ton of coal.

The aqueous coal slurry was conditioned for an additional minute and then 0.04 milliliter of a commercial frother sold under the trade name DOWFROTH 1012 by The Dow Chemical Company was added. This frother is a polypropylene glycol methyl ether having an average molecular weight of about 400. The aqueous coal slurry was agitated for one more minute. Aeration of the slurry at a rate of 9 liters of air per minute was initiated and continued for 4 minutes. The frothy concentrate was collected by means of a motorized paddle.

The collected coal concentrate was dried overnight and then weighed. A one-gram sample of each dried concentrate was ignited and maintained under an oxygen-containing atmosphere at 750° C. for 1.5 hours. The ash content of the concentrate was determined from the weight remaining after combustion. The percent recovery of clean coal by flotation was determined from the weight of clean coal (i.e., total weight of coal concentrate less weight of ash) in the concentrate divided by the weight of the coal feed. Table I tabulates the identity of the conditioner, the percentage amide precursor present in the conditioner, the coal recovery and ash content for each example and comparative experiment.

Comparative Experiments A, B and C

In a manner similar to Example 1, 2-phenyl-2-imidazoline and 2-benzyl-2-imidazoline were tested as conditioners in coal flotation. These compounds are taught in the prior art to be good flotation agents for coal. In a third run, no imidazoline was added. The results are tabulated in Table II. In these three experiments, clean coal recovery and selectivity were both poor.

TABLE I

| Example | In Formula I R | In Formula I X | Percent Amide in Conditioner | Clean Coal Recovery (%) | Ash Content (%) |
|---|---|---|---|---|---|
| 1 | $H\text{-}(CH_2)_{17}\text{-}$ | $-CH_2CH_2NH_2$ | 55.6 | 55.9 | 10.0 |
| 2 | " | " | 2.4 | 51.4 | 10.3 |
| 3 | $H\text{-}(CH_2)_9\text{-}$ | " | * | 38.5 | 11.0 |
| 4 | $H\text{-}(CH_2)_{17}\text{-}$ | $-CH_2CH_2NHC(=O)\text{-}(CH_2)_{17}\text{-}H$ | 44.4 | 57.4 | 10.2 |
| 5 | " | $-CH_2CH_2OH$ | * | 61.0 | 10.5 |
| 6 | " | $-CH_2CH_2OC(=O)\text{-}(CH_2)_{17}\text{-}H$ | 66.8 | 57.3 | 10.1 |
| 7 | $H\text{-}(CH_2)_{11}\text{-}$ | $-CH_2CH_2OCH_2C(=O)-OH$ | * | 36.3 | 11.3 |
| 8 | $H\text{-}(CH_2)_{17}\text{-}$ | " | * | 37.2 | 11.2 |

TABLE I-continued

| Example | In Formula I R | In Formula I X | Percent Amide in Conditioner | Clean Coal Recovery (%) | Ash Content (%) |
|---|---|---|---|---|---|
| 9 | " | $-CH_2CH_2OCH_2\overset{O}{\overset{\|}{C}}-O(CH_2)_{12}H$ | * | 49.7 | 10.3 |

*Less than 2 percent amide present.

TABLE II

| Comparative Experiments** | Imidazoline | Clean Coal Recovery (%) | Ash Content (%) |
|---|---|---|---|
| A | 2-phenyl-2-imidazoline | 26.6 | 13.3 |
| B | 2-benzyl-2-imidazoline | 25.3 | 13.3 |
| C | None | 25.8 | 13.0 |

**Not embodiments of this invention.

EXAMPLES 10–11

In a manner otherwise similar to Examples 2 and 5, 0.5 ml of a homogeneous mixture of 45 parts refined kerosene, 45 parts deionized water, 5 parts imidazoline conditioner and 5 parts acetic acid were added to the coal slurry in place of the aqueous kerosene mixture used in these examples. The results are tabulated in Table III. In each instance the acetic acid diminished the recovery of clean coal, but in Example 11 the selectivity of the conditioner improved.

TABLE III

| Example | In Formula I R | In Formula I X | Percent Amide in Conditioner | Clean Coal Recovery (%) | Ash Content (%) |
|---|---|---|---|---|---|
| 10 | $H-(CH_2)_{17}-$ | $-CH_2CH_2NH_2$ | 2.4 | 32.2 | 11.2 |
| 11 | " | $-CH_2CH_2OH$ | 2.0 | 50.1 | 10.0 |

EXAMPLE 12

In a manner otherwise similar to Example 2, the pH of the coal slurry was adjusted to 4.0 by the addition of dilute HCl prior to flotation. The recovery of clean coal during flotation declined to 45.7 percent, but the ash content of the concentrate was the same as in Example 2.

EXAMPLES 13–18

In a procedure otherwise similar to Example 1, 9 different imidazolinium salts were tested as conditioners for the flotation of oxidized coal. Each salt corresponds to formula II wherein R is $\rangle(CH_2-_{11}H$, R'' at each occurrence is —H and R' and Y are as tabulated in Table IV. The clean coal recovery and ash content observed in each experiment are also presented in Table IV.

TABLE IV

| Example | In Formula II R' | In Formula II Y | Clean Coal Recovery (%) | Ash Content (%) |
|---|---|---|---|---|
| 13 | $-CH_2\overset{O}{\overset{\|}{C}}-O^{\ominus}$ | $-CH_2O\overset{O}{\overset{\|}{C}}(CH_2)_5H$ | 36.9 | 11.3 |
| 14 | " | $-CH_2O\overset{O}{\overset{\|}{C}}(CH_2)_{17}H$ | 54.3 | 9.3 |
| 15 | " | $-CH_2OH$ | 32.0 | 11.7 |
| 16 | $-CH_2\underset{\underset{OH}{\|}}{CH}-CH_2SO_3^{\ominus}$ | " | 33.8 | " |
| 17 | $-CH_2-\underset{\underset{O-\overset{O}{\overset{\|}{C}}-CH_3}{\|}}{CH}-CH_2SO_3^{\ominus}$ | $-CH_2O\overset{O}{\overset{\|}{C}}-CH_3$ | 42.4 | 10.9 |
| 18* | $-CH_2\underset{\underset{O(\overset{O}{\overset{\|}{C}}-CH_2)_{0.5}H}{\|}}{CH}-CH_2SO_3^{\ominus}$ | $-CH_2O\overset{O}{\overset{\|}{C}}-CH_2)_{0.5}H$ | 41.9 | 12.2 |

*Conditioner only 50 percent esterified.

EXAMPLE 19

In a manner otherwise similar to Example 14, 0.5 ml of a homogeneous mixture of 45 parts kerosene, 45 parts deionized water, 5 parts imidazoline conditioner and 5 parts acetic acid was added to the coal slurry in place of the aqueous kerosene mixture used in Example 14. The clean coal recovery rose slightly in the presence of acetic acid (54.7%) while the ash content of the coal recovered dropped to 8.0 percent.

EXAMPLE 20

In a manner otherwise similar to Example 15, 0.5 ml of a homogeneous mixture of 45 parts kerosene, 45 parts deionized water, 5 parts imidazoline conditioner and 5 parts acetic acid was added to the coal slurry in place of the aqueous kerosene mixture used in Example 15. The clean coal recovery rose in the presence of the acetic acid to 32.9% while the ash content dropped to 10.4 percent.

What is claimed is:

1. A froth flotation process for beneficiating coal having an oxidized surface which comprises the steps of:

(a) classifying the coal to separate particles of flotation size; and (b) floating the sized coal in a frothing aqueous medium comprising a fuel oil collector and an effective amount of a compound corresponding to the formula

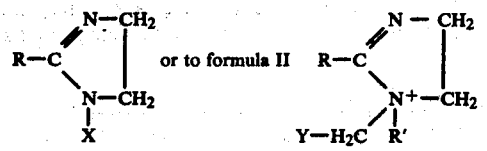

wherein

R in formula I and II is a $C_6$ to $C_{22}$ alkyl or $C_6$ to $C_{22}$ alkenyl;

X is —H, $C_1$ to $C_{22}$ alkyl, $$-CH_2CH_2NH-\overset{O}{\overset{\|}{C}}\leftarrow C_1$$

to $C_{22}$ alkyl, $C_2$ to $C_{22}$ alkenyl or —H), $-CH_2CH_2NH_2$, $-CH_2CH_2OH$, $$-CH_2CH_2O\overset{O}{\overset{\|}{C}}\leftarrow C_1$$

to $C_{22}$ alkyl, $C_2$ to $C_{22}$ alkenyl or —H), $$-CH_2CH_2O\underset{Q}{\underset{|}{C}}H\underset{Q}{\underset{|}{C}}H-OH,$$

each Q being independently —H or $-CH_3$, or $$-CH_2CH_2O(CH_2)_t\overset{O}{\overset{\|}{C}}-O\leftarrow C_1$$

to $C_{22}$ alkyl, $C_2$ to $C_{22}$ alkenyl or —H), t being an integer 1 to 2;

Y is —H, $C_1$ to $C_{21}$ alkyl, $-CH_2OH$, $$-CH_2O\overset{O}{\overset{\|}{C}}\leftarrow C_1$$

to $C_{22}$ alkyl, $C_2$ to $C_{22}$ alkenyl) or $$-CH_2CH_2O\underset{Q}{\underset{|}{C}}H\underset{Q}{\underset{|}{C}}H-OH,$$

each Q being independently —H or $-CH_3$; and R′ is $$-CH_2-\overset{O}{\overset{\|}{C}}-O^{\ominus} \text{ or } -CH_2-\underset{M}{\underset{|}{C}}H-CH_2-SO_3^{\ominus},$$

M being —H, —OH or $$-O-\overset{O}{\overset{\|}{C}}\leftarrow H,$$

$C_1$ to $C_{22}$ alkyl or $C_2$ to $C_{22}$ alkenyl).

2. The process as described in claim 1 wherein R in formula I and formula II is $C_{11}$ to $C_{17}$ alkyl or $C_{11}$ to $C_{17}$ alkenyl.

3. The process as described in claim 1 wherein a compound corresponding to formula II is present and R′ is $$-CH_2\overset{O}{\overset{\|}{C}}-O^{\ominus}$$

and Y is $$-CH_2O-\overset{O}{\overset{\|}{C}}\leftarrow C_{11}$$

to $C_{17}$ alkyl or $C_{11}$ to $C_{17}$ alkenyl).

4. The process as described in claim 1 wherein a compound corresponding to formula I is present and X is $-CH_2CH_2NH_2$, $-CH_2CH_2OH$, $$-CH_2CH_2NH-\overset{O}{\overset{\|}{C}}\leftarrow C_{11}$$

to $C_{17}$ alkyl or $C_{11}$ to $C_{17}$ alkenyl).

5. The process as described in claim 4 wherein the imidazoline is present with an amide precursor of the imidazoline.

* * * * *